US005287639A

United States Patent [19]

Tonel

[11] Patent Number: 5,287,639

[45] Date of Patent: Feb. 22, 1994

[54] SPORTS SHOE WITH QUICK-RELEASE QUARTER

[75] Inventor: Valerio Tonel, Biadene, Italy

[73] Assignee: Nordica S.p.A., Montebelluna, Italy

[21] Appl. No.: 989,663

[22] Filed: Dec. 14, 1992

[30] Foreign Application Priority Data

Dec. 20, 1991 [IT] Italy ..... TV91A000131

[51] Int. Cl.[5] ..... A43B 5/04

[52] U.S. Cl. ..... 36/117; 36/120

[58] Field of Search ..... 36/117, 118, 119, 120, 36/121

[56] References Cited

U.S. PATENT DOCUMENTS

| | | | |
|---|---|---|---|
| 4,095,356 | 6/1978 | Robran et al. | 36/121 |
| 4,379,370 | 4/1983 | Balbinot | 36/121 |
| 4,499,676 | 2/1985 | Chalmers, II | 36/117 X |
| 4,658,517 | 4/1987 | Miyoshi et al. | 36/117 |
| 4,864,743 | 9/1989 | Begey et al. | 36/119 |
| 4,928,406 | 5/1990 | Montfort | 36/121 X |
| 5,062,226 | 11/1991 | Sartor et al. | 36/117 |
| 5,067,258 | 11/1991 | Martignago | 36/117 |
| 5,136,794 | 8/1992 | Stampacchia et al. | 36/117 |
| 5,152,085 | 10/1992 | Baggio et al. | 36/117 |

FOREIGN PATENT DOCUMENTS

| | | | |
|---|---|---|---|
| 0120267 | 10/1084 | European Pat. Off. | 36/117 |
| 0286586 | 10/1988 | European Pat. Off. | 36/117 |
| 0342463 | 11/1989 | European Pat. Off. . | |
| 2907163 | 8/1980 | Fed. Rep. of Germany . | |
| 2278280 | 2/1976 | France . | |
| 529525 | 10/1972 | Switzerland . | |

*Primary Examiner*—Paul T. Sewell
*Assistant Examiner*—BethAnne Cicconi
*Attorney, Agent, or Firm*—Guido Modiano; Albert Josif; Daniel O'Byrne

[57] ABSTRACT

A sports shoe includes a shell having a rear quarter. The quarter is provided, in a downward position and to the rear, with a recess. The sports shoe includes a flap which is articulated to the shell and affects the recess; the flap is provided with a projection for engaging the quarter at the recess providing a rear support of the quarter. The flap can be disengaged from the quarter by the user by pressing the projection or the flap in the direction of the leg.

10 Claims, 4 Drawing Sheets

SPORTS SHOE WITH QUICK-RELEASE QUARTER

BACKGROUND OF THE INVENTION

The present invention relates to a sports shoe.

Currently, for example in the manufacture of ski boots, it is known to articulate, at a shell, at least one quarter which embraces the rear region of the user's leg and must allow for an easy fit of the foot and the support of the leg of the user during sports practice.

This means that on one hand, the quarter has to rotate as much as possible for opening the boot to facilitate the insertion of the foot in the shell and on the other hand, the quarter must support the leg when the leg leans on the back of the quarter.

On this subject, French patent no. 71.2195, claiming Japanese priority no. 49.858/1970 of Jun. 11, 1970 and no. 131.142/1970 of Dec. 23, 1970, discloses a sports shoe comprising a rear quarter which is articulated to a shell and wherein a device for interconnecting the shell and the front quarter provides the rear support. The front quarter is in fact rigidly coupled to the rear quarter by means of adapted levers.

This solution has considerable disadvantages: on one hand, both the shell and the front quarter must be appropriately strengthened in order to withstand the stresses imparted thereto by the interconnection device and, on the other hand, the rear support can be achieved only by acting at two separate levers connecting the front quarter with the rear quarter.

U.S. Pat. No. 4,095,356 filed on Oct. 15, 1976, discloses a sports shoe which comprises a rear quarter having a recess at which it is possible to arrange a flap which is articulated to a shell: however, in this known solution the flap only allows a wider opening of the front quarter with respect to the rear one, thus facilitating the insertion of the skier's foot, but has no effect on the rear support, because the support is ensured exclusively by the interconnection between the rear quarter and the front quarter and with optional means for adjusting the mutual position of the front quarter and of the shell, interposed between these last.

U.S. Pat. No. 4,839,973, filed on Apr. 9, 1987, discloses a sports shoe comprising a shell to which a quarter is pivoted. The quarter is provided, at the rear, with a recess at which it is possible to arrange a cuff which embraces the heel region and is in turn articulated laterally to the shell.

Connecting means are interposed between the cuff and the quarter. A lever is associated with the cuff and selectively interacts with a tooth which protrudes to the rear of the shell.

This known solution allows, upon activation of the lever, to disengage the lever from the tooth and open the quarter by virtue of the articulation of said quarter to said upper quarter.

However, this solution has problems, since it is structurally complicated and difficult to industrialize, thus requiring numerous manufacturing steps due to the means used and to their placement at the quarter and the cuff, and all this increases its production costs.

Also, the user has to act on two distinct elements, such as the lever and the connecting means.

Finally, when the quarter is opened there is a considerable deformation imposed at a flap which is associated with the shell and protrudes to the rear of said shell.

SUMMARY OF THE INVENTION

The aim of the present invention is to eliminate the problems described above in known types by providing a shoe which allows to rapidly, easily and optimally achieve rear support for a quarter during sports practice.

Within the scope of the above aim, an object is to provide a shoe which allows the user to rapidly and easily insert his foot in the boot.

Another important object is to provide a shoe which associates with the preceding characteristics that of being structurally simple.

Not least object is to provide a shoe which is easy to industrialize, reliable and safe in use, and has modest manufacturing costs.

This aim and these objects, as well as others which will become apparent hereinafter, are achieved by a sports shoe, comprising at least one quarter associated with a shell, said quarter being provided with a recess in a downward position and to the rear, characterized in that it comprises a flap which is articulated to said shell and affects said recess, said flap being provided with an engagement means for engaging said at least one quarter for rear support, said flap being disengageable from said at least one quarter by the user by pressing the flap toward the leg.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figures 1, 2, 3, 4:
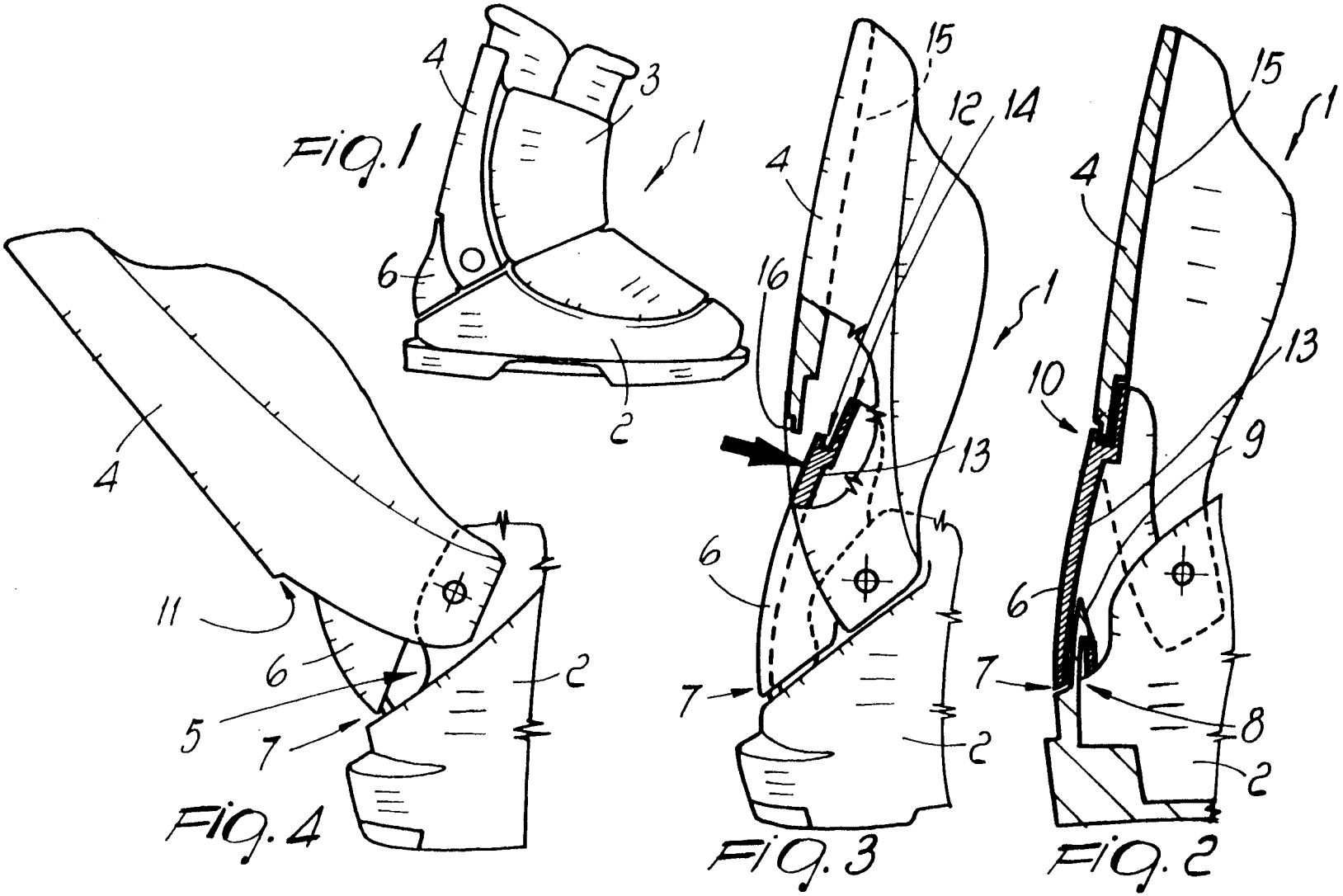
FIG. 1 is a side view of the sports shoe.
FIG. 2 is a partial sectional view, taken along a longitudinal median plane, of the shoe, wherein the flap is engaged with the quarter.
FIG. 3 is a partially sectional view of the shoe with the flap disengaged from the quarter.
FIG. 4 is a partial side view of the shoe, wherein the rear part of the quarter is open.

FIGS. 1-4 show a sports shoe, namely a ski boot, generally designated by the reference numeral 1, composed of a front quarter 3 and a rear quarter 4 articulated to a shell 2.

Rear quarter 4 has a rear recess 5 at which a complementarily shaped flap 6 can be arranged.

Flap 6 has a seat 8, at its lower perimetric edge 7 which abuts against said shell upon a rotation which can be imparted outward. Seat 8 is adapted to engage a grip element constituted by a resilient tongue 9. Tongue 9 is shaped like a hook at its terminal end and protrudes at the rear of the shell 2.

Tongue 9 allows the flap 6 to oscillate with respect to the shell 2.

An engagement means is at the upper perimetric edge 10 of the flap 6 for engaging a complementarily shaped grip means formed on the lower perimetric edge 11 of the quarter 3. The engagement means is constituted by a groove 12 which forms at least one step from which a wing 14 protrudes toward the overlying rear quarter 4 and starting from the inner lateral surface 13 of flap 6. Wing 14 can abut against the inner lateral surface 15 of rear quarter 4.

The grip means formed on the lower perimetric edge 11 of the rear quarter 4 is constituted by a tooth or tang 16 which can be temporarily accommodated within the underlying groove 12.

Arrangement of the tooth or tang 16 within the groove 12 allows to achieve rear support for the rear quarter 4.

Flap 6 can be disengaged from the rear quarter 4 by the user by pressing the flap, toward the leg, as shown in FIG. 3.

This operation entails the disengagement of the tang 16 from the groove 12, because of the elastic deformations to which the tang is subjected, allowing the rear quarter 4 to be opened, as shown in FIG. 4, so as to be able to remove or insert the foot from or in the shell.

It has thus been observed that the sports shoe according to the invention has achieved the above described aim and objects, a shoe having been provided which allows to achieve optimum and easy rear support of the rear quarter and easy insertion or removal of the foot in or from the shell, this last characteristic being actuated directly by the user in a rapid and simple manner.

The shoe is also structurally very simple and can thus be obtained with low production costs.

The sports shoe thus conceived is susceptible to numerous modifications and variations, all of which are within the scope of the inventive concept.

Thus, for example, FIGS. 5-9 illustrate a sports shoe according to a second aspect, namely a ski boot, generally designated by the reference numeral 101, and composed of a shell 102 to which a single quarter 103 is articulated.

A flap 106 is formed at the rear portion of the shell 102. The flap embraces the region of the user's heel and oscillates with respect to the shell.

Flap 106 is arranged at a recess 105 formed on the rear of quarter 103.

The flap 106 has, at its upper perimetric edge 110, an engagement means for engaging a complementarily shaped grip means which is constituted by the lower perimetric edge 111 of quarter 103. The engagement means is constituted by a perimetric step recess 112 from which a wing 114 protrudes toward the overlying quarter 103 and is adapted to abut against the inner lateral surface 115 of the quarter 103.

The lower perimetric edge 111 of the quarter 103 abuts against the perimetric step recess when a backward rotation is imparted to the quarter 103.

Figures 5, 6, 7, 8, 9:
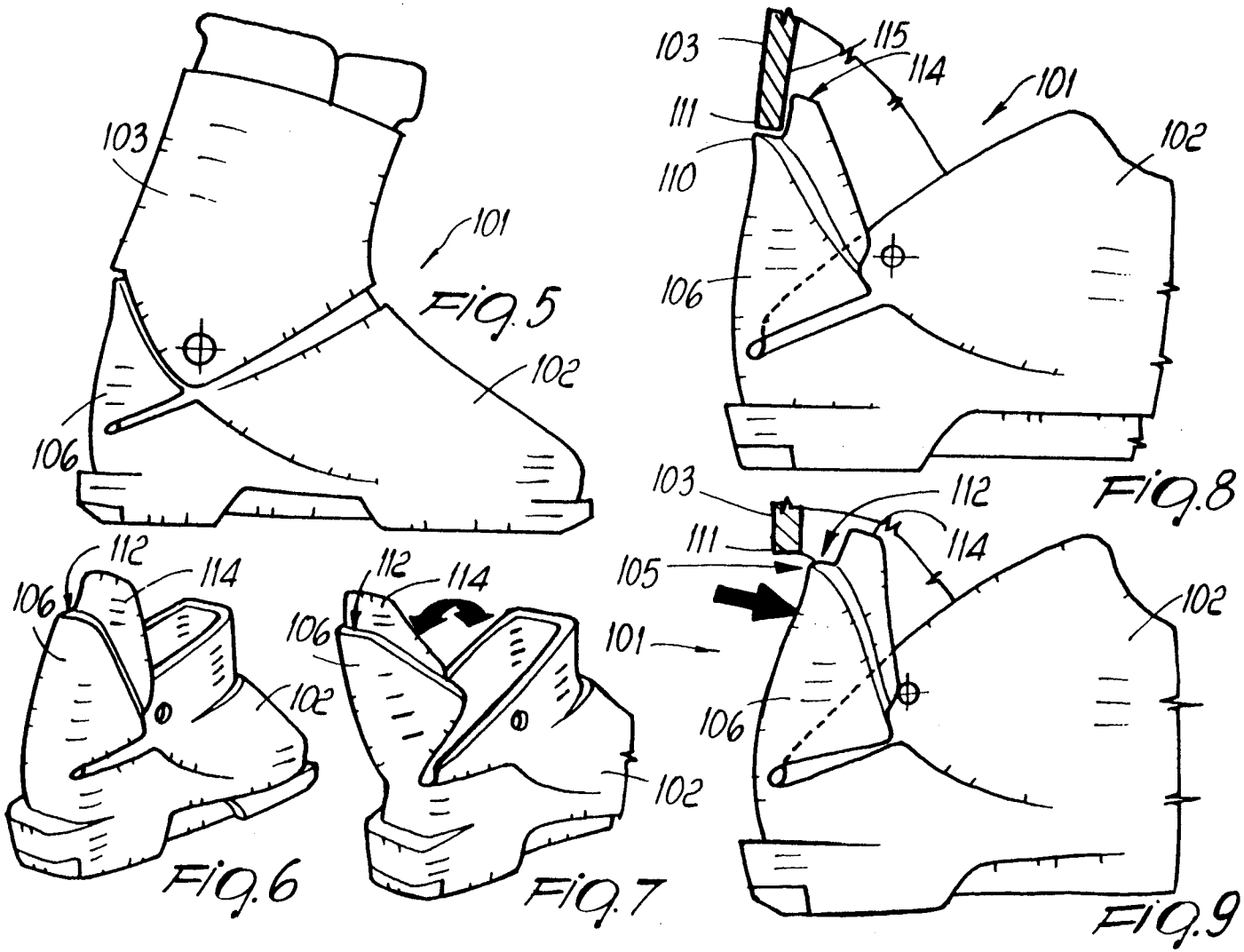
FIG. 5 is a side view of a second embodiment.
FIG. 6 is a rear perspective view of the shell of a second embodiment of the shoe.
FIG. 7 is a view, similar to the preceding one, of the shell, illustrating the way in which the flap can move.
FIG. 8 is a partially sectional side view of the second embodiment with the flap engaged with the quarter.
FIG. 9 is a view, similar to the preceding one, of the second embodiment with the flap disengaged from the quarter.

The flap 106 can be disengaged from the quarter 103 by the user by pressing the flap toward the leg, as shown in FIG. 9.

This operation entails the disengagement of the lower perimetric edge 111 of the quarter 103 from the perimetric step recess 112 by virtue of the elastic deformation to which the flap 106 can be subjected.

Figure 11:
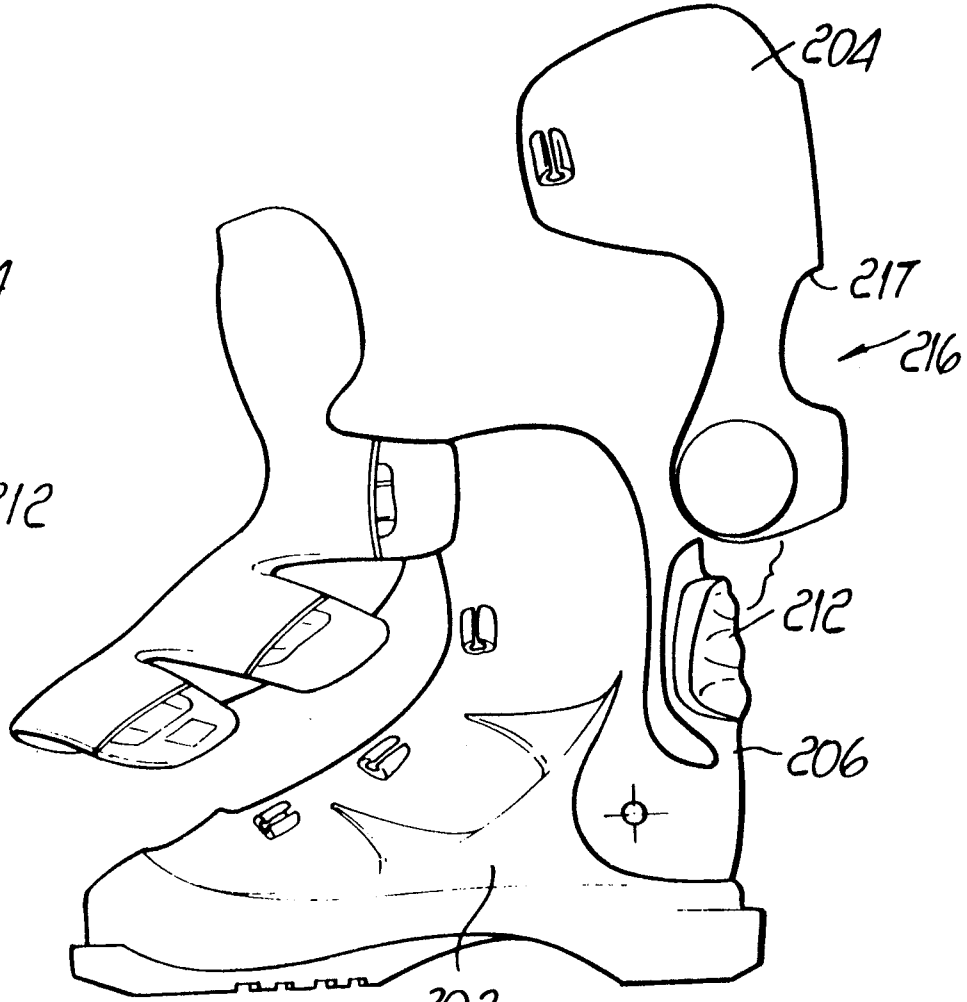
FIG. 11 is an exploded side view of the sports shoe of FIG. 10.
Figure 10:
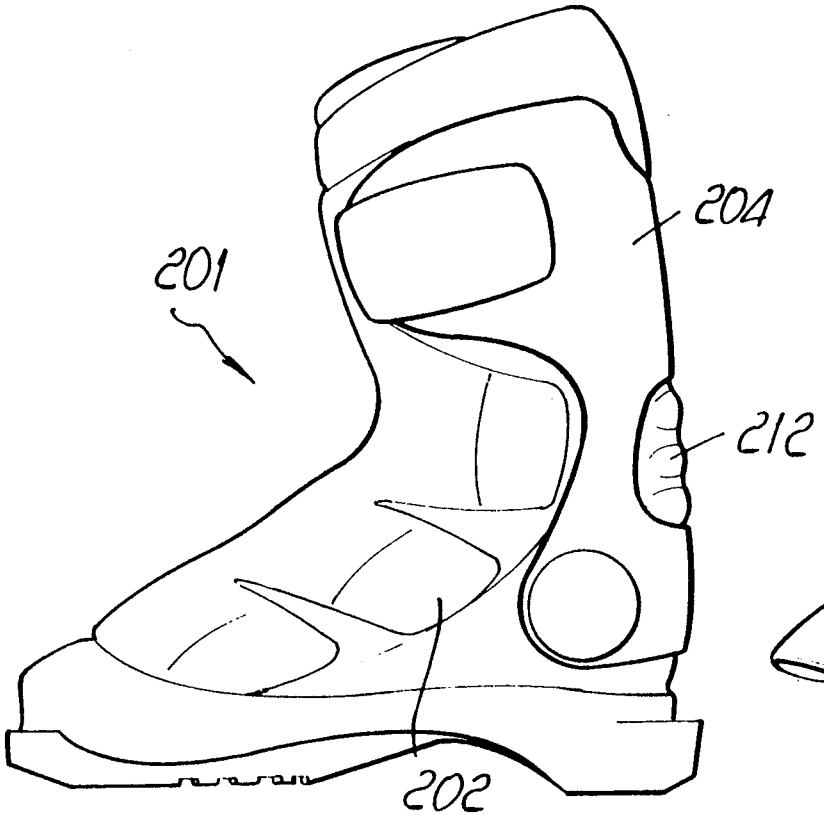
FIG. 10 is a side view of a sports shoe according to a third aspect of the invention.
Figure 12:
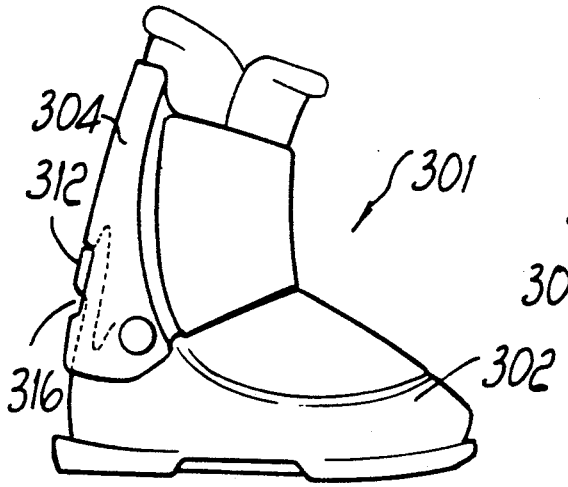
FIG. 12 is a side view of a sports shoe according to a fourth aspect of the invention.
Figure 13:
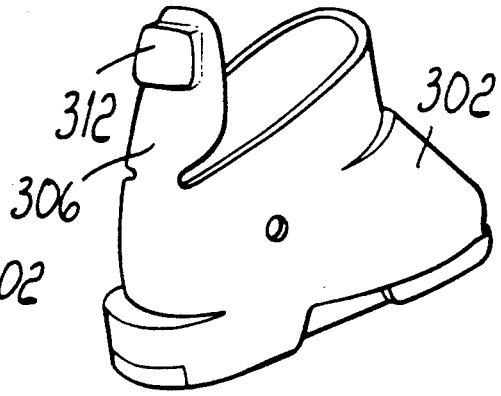
FIG. 13 is a rear perspective view of the shell of the sports shoe of FIG. 12.
Figure 14:
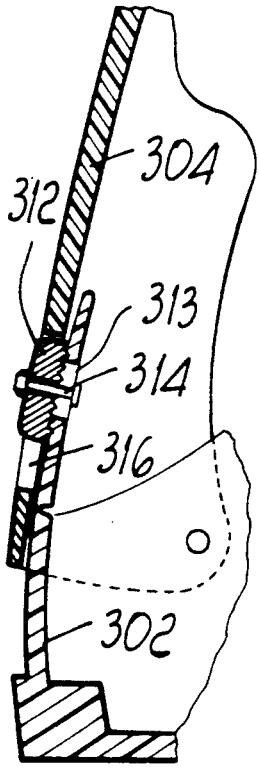
FIGS. 14–16 are side cross-section partial views of the shoe of FIGS. 12–13, showing the quarter respectively engaged with the flap, disengaged from the flap, and in the open position.
Figure 15:
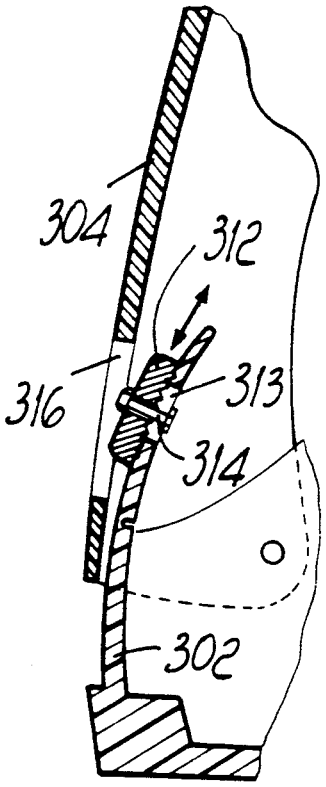
Figure 16:
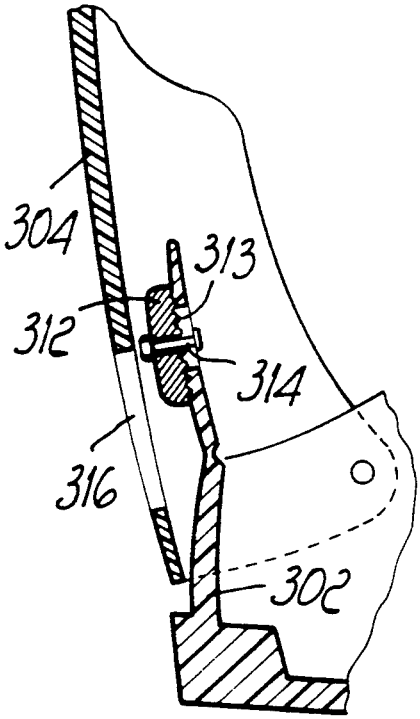

FIGS. 10-11 illustrate a sports shoe 201 according to a third aspect of the invention. The sports shoe 201, which is again a ski boot, includes a rear quarter 204 articulated to a shell 202. A flap 206 is formed at the rear portion of shell 202. Flap 206 can be integral with the shell, formed by injection-molding for example, or can be a separate piece snap fastened to the shell. Flap 206 has a projection 212 on its outer side, adapted to engage a hole 216 formed at the rear quarter 204.

As shown in FIG. 10, when the boot 201 is closed, the projection 212 protrudes from the hole 216 and the upper edge 217 of the hole abuts against the projection 212 allowing a rear support of the quarter.

For opening the boot, the user will press the projection 212, in the direction of the leg, disengaging the projection 212 from the hole 216 and allowing the quarter to rotate backward.

FIGS. 12-16 illustrate a sports shoe 301 according to a fourth aspect of the invention. The sports shoe, which is a ski boot in the illustrated example, includes a rear quarter 304 articulated to a shell 302. Shell 302 has a rear flap 306 which includes a projection 312 adapted to engage a hole 316 provided on the rear quarter 304, similarly to the sports shoe 201 described above.

Flap 306 has a slot 313 adapted to engage a bolt 314 which is associated with the projection 312. The projection 312 is in fact constituted by a block which can slide on the flap 306, along the slot 313, for adjusting its vertical position. The adjustment of the Vertical position of the projection 312 can be effected by simply untightening the bolt 314, moving the projection in the selected position, and retightening the bolt 314. In this manner it is possible to adjust the inclination of the quarter 304 with respect of the shell 302.

I claim:

1. Sports shoe, comprising at least one quarter associated with a shell, said quarter being provided with a recess in a downward and rear position thereof, the sports shoe further comprising a flap which is articulated to said shell and affects said recess, said flap being provided with an engagement means for engaging said at least one quarter for rear support, said flap being disengageable from said at least one quarter by the user by pressing the flap toward the leg, said flap having an upper perimetric edge at which are arranged said engagement means, a grip means for gripping said engagement means being formed on a lower perimetric edge of said at least one quarter, said engagement means comprising at least one groove forming a step from which a wing protrudes in a direction towards said at least one quarter, said wing abutting on an inner lateral surface of said quarter in a closed position of said quarter.

2. Sports shoe according to claim 1, wherein said flap has, at its lower perimetric edge, which abuts against said shell upon a rotation which can be imparted toward the outside, a seat for a grip element which is constituted by a resilient tongue which is shaped like a hook at its terminal end and protrudes to the rear of said shell.

3. Sports shoe according to claim 1, wherein said grip means formed on said lower perimetric edge of said at least one quarter is constituted by a tang which can be temporarily accommodated within said groove.

4. Sports shoe according to claim 3, wherein said tang is elastically deformable and can be temporarily accommodated at said groove, said tang and said groove being stably interconnected following pressure applied on said at least one quarter and flap by the user's leg.

5. Sports shoe, comprising at least one quarter associated with a shell, said quarter being provided with a recess in a downward and rear position thereof, the sports shoe further comprising a flap which is articulated to said shell and affects said recess, said flap being provided with an engagement means for engaging said at least one quarter for rear support, said flap being disengageable from said at least one quarter by the user by pressing the flap toward the leg, wherein said flap has an upper perimetric edge, said at least one quarter having a lower perimetric edge which constitutes a grip means for gripping the upper perimetric edge of said flap, said engagement means being constituted by a perimetric step recess from which a wing protrudes toward said at least one quarter, said wing abutting on an inner lateral surface of said quarter when said quarter is in a closed position.

6. Sports shoe according to claim 5, wherein said lower perimetric edge of said quarter abuts against said perimetric step recess upon a rearward imparted to said quarter.

7. Sports shoe, comprising at least one quarter associated with a shell, said quarter being provided with a recess in a downward and rear position thereof, the sports shoe further comprising a flap which is articulated to said shell and affects said recess, said flap being provided with an engagement means for engaging said at least one quarter for rear support, said flap being disengageable from said at least one quarter by the user by pressing the flap toward the leg, wherein said recess is constituted by a hole provided in a lower rear region of said quarter, said engagement means comprising a projection formed on said flap of said shell.

8. Sports shoe, comprising at least one quarter associated with a shell, said quarter being provided with a recess in a downward and rear position thereof, the sports shoe further comprising a flap which is articulated to said shell and affects said recess, said flap being provided with an engagement means for engaging said at least one quarter for rear support, said flap being disengageable from said at least one quarter by the user by pressing the flap toward the leg, wherein said recess is constituted by a hole provided in a lower rear region of said quarter, said engagement means comprising a projection provided at said flap of said shell, said projection being movable on said flap for adjusting the vertical position of said projection on said flap, for adjusting the inclination of said quarter with respect to said shell.

9. Sports shoe according to claim 8, wherein said flap has a substantially vertical slot, a bolt member being associated with said projection, said bolt member being slideably engaged in said vertical slot.

10. A sports shoe comprising:

a shell;

at least one quarter pivotally connected with said shell, said quarter being provided with a through recess in a downward position thereof;

a flap element pivotally carried by said shell and being arranged in a position at said recess of said quarter and at least partially inside said quarter, the flap element being accessable to a user through the recess of the quarter from outside the sports shoe;

engagement means carried by said flap element for engaging in said through recess of said quarter thereby to hold said quarter in a closed position;

and wherein said flap element is pushable inwardly of the sports shoe to rotate said flap element for disengaging said engagement means from said recess of the quarter thereby to allow the quarter to rotate into an open position.

* * * * *